US009465345B2

(12) United States Patent
Mori

(10) Patent No.: US 9,465,345 B2
(45) Date of Patent: Oct. 11, 2016

(54) IMAGE FORMING APPARATUS

(71) Applicant: BROTHER KOGYO KABUSHIKI KAISHA, Nagoya, Aichi (JP)

(72) Inventor: Hirotaka Mori, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 14/608,486

(22) Filed: Jan. 29, 2015

(65) Prior Publication Data

US 2015/0220039 A1 Aug. 6, 2015

(30) Foreign Application Priority Data

Jan. 31, 2014 (JP) ..... 2014-017473

(51) Int. Cl.

| | |
|---|---|
| ***B65H 5/02*** | (2006.01) |
| ***G03G 15/00*** | (2006.01) |
| ***B65H 5/06*** | (2006.01) |
| ***B65H 9/00*** | (2006.01) |
| *G03G 15/01* | (2006.01) |

(52) U.S. Cl.

CPC ..... *G03G 15/6561* (2013.01); *B65H 5/021* (2013.01); *B65H 5/062* (2013.01); *B65H 9/006* (2013.01); *B65H 2404/253* (2013.01); *G03G 15/0194* (2013.01)

(58) Field of Classification Search

CPC ..... G03G 2215/00139; G03G 15/6558; G03G 15/6567; G03G 2215/0141; G03G 15/6561; B65H 2404/253; B65H 5/021; B65H 9/006

See application file for complete search history.

(56) References Cited

U.S. PATENT DOCUMENTS 5,199,696 A * 4/1993 Kato ..... B65H 3/0669 271/10.13
7,305,209 B2 * 12/2007 Takata ..... G03G 15/602 399/367
2009/0003847 A1 * 1/2009 Dan ..... G03G 15/6567 399/9
2009/0190978 A1 7/2009 Ikezaki
2011/0076035 A1 3/2011 Iwakawa
2012/0237280 A1 * 9/2012 Yoshimura ..... G03G 15/6558 399/388
2013/0101322 A1 4/2013 Nakano

FOREIGN PATENT DOCUMENTS

| | | | |
|---|---|---|---|
| JP | 2000-185840 | A | 7/2000 |
| JP | 2000-219354 | A | 8/2000 |
| JP | 2002-365870 | A | 12/2002 |
| JP | 2003-149889 | A | 5/2003 |
| JP | 2009-180790 | A | 8/2009 |
| JP | 2009-210899 | A | 9/2009 |
| JP | 2010-072351 | A | 4/2010 |
| JP | 2011-075665 | A | 4/2011 |
| JP | 2013-088653 | A | 5/2013 |

* cited by examiner

*Primary Examiner* — Jennifer Simmons

(74) *Attorney, Agent, or Firm* — Scully, Scott, Murphy & Presser, P.C.

(57) ABSTRACT

An image forming apparatus, including a conveyer unit, an image forming unit, and a registration unit, is provided. The conveyer includes a first roller, a second roller, and a belt having a first surface to contact the sheet. The image forming unit forms an image on the sheet in an image forming area. The registration unit is on an upstream side of the image forming area and includes a third roller and a fourth roller. A rotation axis of the third roller is on a side of the first surface, and a rotation axis of the fourth roller is on a side of a second surface of the belt, which is a reverse surface of the first surface. The registration unit manipulates the third and fourth rollers to align the sheet with a reference orientation and convey the sheet to the belt.

13 Claims, 9 Drawing Sheets

IMAGE FORMING APPARATUS

CROSS REFERENCE TO RELATED APPLICATION

This application claims priority from Japanese Patent Application No. 2014-017473, filed on Jan. 31, 2014, the entire subject matter of which is incorporated herein by reference.

BACKGROUND

1. Technical Field

An aspect of the present disclosure relates to a technique to correct skew of a sheet by a registration unit and convey the sheet to a belt.

2. Related Art

An image forming apparatus, in which a belt is circulated to convey a sheet, and an image is formed on the sheet being conveyed, is conventionally known. The image forming apparatus may have a registration unit arranged on an upstream side of the belt with regard to a direction of conveying the sheet. The registration unit may have a pair of rollers, of which rotation axes are located outside the belt. The registration unit may correct skew of the sheet to a reference orientation and feed the corrected sheet to the belt.

SUMMARY

In the conventional configuration of the image forming apparatus, the rotation axes of the paired rollers in the registration unit may be located on the outside, e.g., on a side of an outer surface, of the belt. In this regard, a distance for the sheet to travel from the registration unit to the belt may have a considerable length, in which the sheet may be skewed again before reaching the belt. Therefore, even if the skew of the sheet may be corrected to align with the reference orientation by the registration unit, the sheet may be skewed with respect to the reference orientation again while traveling the distance.

The present disclosure is advantageous in that a technique to restrain a sheet from being fed to a belt in a skewed orientation with respect to a reference orientation is provided.

According to an aspect of the present disclosure, an image forming apparatus, including a conveyer, an image forming unit, and a registration unit, is provided. The conveyer includes a first roller, a second roller, and a belt strained around the first roller and the second roller. The belt includes a first surface configured to contact the sheet. The image forming unit is configured to form an image on the sheet being conveyed in an image forming area. The image forming area includes at least a part of a first area and at least a part of a second area. The first area is coincident with the belt, and the second area is displaced from the belt along a direction of rotation axis of the first roller. The registration unit is arranged on an upstream side of the image forming area with regard to a direction of conveyance to convey the sheet by the conveyer. The registration unit includes a third roller and a fourth roller. The third roller is arranged to contact the fourth roller and to locate a rotation axis thereof on a side of the first surface. The fourth roller is arranged in the second area with a rotation axis thereof being located on a side of a second surface of the belt which is a reverse surface of the first surface. The registration unit is configured to manipulate the third roller and the fourth roller to align the sheet with a reference orientation and convey the sheet to the belt.

BRIEF DESCRIPTION OF THE ACCOMPANYING DRAWINGS

DETAILED DESCRIPTION

Hereinafter, a printer 1 as an exemplary embodiment of the present disclosure will be described with reference to the accompanying drawings. It is noted that various connections are set forth between elements in the following description. These connections in general, and unless specified otherwise, may be direct or indirect, and this specification is not intended to be limiting in this respect.

Figure 1:
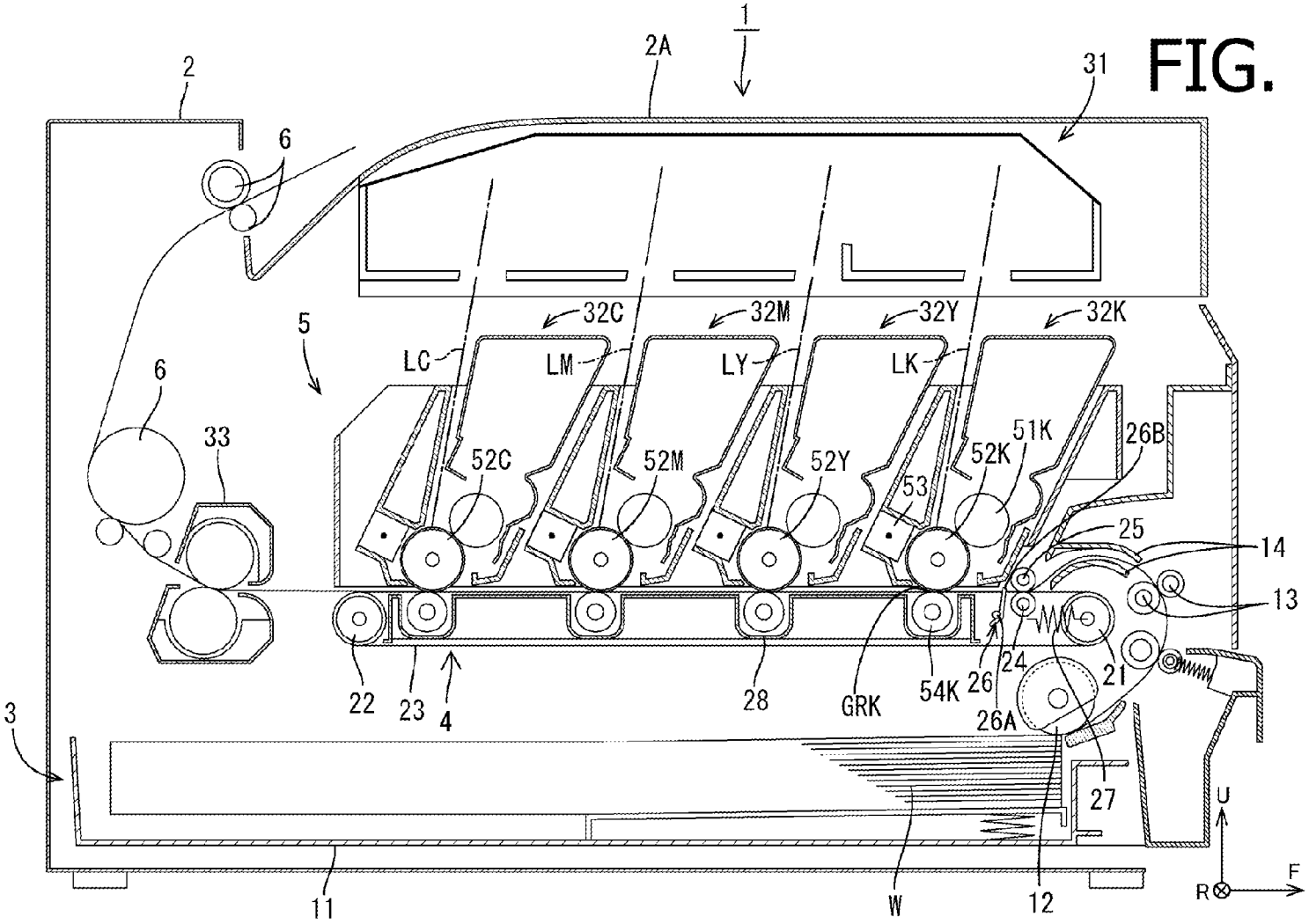
FIG. 1 is an illustrative view of a mechanical configuration of a printer according to an exemplary embodiment of the present disclosure.

The printer 1 is a direct-transferring tandem-typed color laser printer capable of forming images on a sheet in a plurality of (e.g., four) colors, which are, for example, black (K), yellow (Y), magenta (M), and cyan (C). In the following description, directions concerning the printer 1 and each part or component included in the printer 1 will be referred to based on orientations indicated by arrows shown in each drawing. For example, a viewer's right-hand side in FIG. 1 is defined as a front side F, and a left-hand side is defined as rear. A viewer's farther side in FIG. 1 is defined as a right-hand side R of the printer 1, and a nearer side is defined as a left-hand side. An upper side in FIG. 1 corresponds to an upper side U of the printer 1 according to a direction of gravity. A right-to-left or left-to-right direction of the printer 1 may also be referred to as a right-left direction or a widthwise direction. An up-to-down or down-to-up direction with regard to the direction of gravity may also be referred to as a vertical direction. A front-to-rear or rear-to-front direction may be referred to as a front-rear direction or a direction of depth. Furthermore, directions of the drawings in FIGS. 3-9 are similarly based on the orientation of the printer 1 as defined above and correspond to those with respect to the printer 1 shown in FIG. 1 even when the printer 1 in the drawings is viewed from different angles. However, the orientations concerning the printer 1 may not necessarily be limited to those described below or indicated in the accompanying drawings. Further, it is noted that a quantity of each of the components and elements denoted by reference signs is, unless otherwise noted, at least one.

In the printer 1 according to the present disclosure, there may be a plurality of parts or components which are in an identical configuration for forming images in the plurality of colors K, Y, M, C. Those identically-configured parts or components may be indicated by the same reference signs except for letters (K, Y, M, C) at the ends thereof, which indicate the different colors. Meanwhile, the reference sigs without the letters (K, Y, M, C) at the ends may be used to represent the plurality of identically-configured parts or components. In the accompanying drawings, reference signs for some of the parts or components in the identical configuration may be omitted.

The printer 1 includes a main casing 2, a sheet feeder unit 3, a belt unit 4, an image forming unit 5, ejection rollers 6, and a registration unit 7.

The sheet feeder unit 3 includes a feeder tray 11, a pickup roller 12, feeder rollers 13, and a sheet guide 14. The pickup roller 12 forwards sheets W stored in the feeder tray 11 one-by-one to the feeder rollers 13. The sheet guide 14 is arranged to contact the sheet W being conveyed by the feeder rollers 13 and guide the sheet W to the belt unit 4.

The belt unit 4 includes a support roller 21, a driving roller 22, a belt 23 being an endless belt, and a resilient member 27, which are supported by a frame 28. The belt 23 is strained around the support roller 21 and the driving roller 22. The belt 23 is rolled to circulate in a counterclockwise direction in FIG. 1 to convey the sheet W being contacted with an upper outer surface of the belt 23 toward the rear side.

The resilient member 27 is arranged to urge the support roller 21 in a direction to be away from the driving roller 22. Thus, the support roller 21 serves to apply tensile force to the belt 23 so that the belt 23 is restricted from loosening between the driving roller 22 and the support roller 21. On an inner side of the belt 23, arranged are transfer rollers 54. The transfer roller 54 includes a transfer roller 54K for black, a transfer roller 54Y for yellow, a transfer roller 54M for magenta, and a transfer roller 54C for cyan.

The registration unit 7 includes a registration roller 24, a pinch roller 25, and a sheet sensor 26, which are supported by the frame 28 of the belt unit 4. The registration roller 24 and the pinch roller 25 are arranged to contact the sheet W being conveyed before the sheet W reaches the belt 23 and correct skewing of the sheet W to a reference orientation so that the sheet W is conveyed to the belt 23 in a correct reference orientation in the printer 1.

The sheet sensor 26 is arranged to detect presence of the sheet W in a detectable area, which is between the registration roller 24 and the transfer rollers 54, and outputs signals according to detected presence or absence of the sheet W in the detectable area. Based on the signals from the sheet sensor 26, a timing to form an image on the sheet W is determined.

The image forming unit 5 includes a scanner unit 31, processing units 32K, 32Y, 32M, 32C, and a fixing unit 33.

The scanner unit 31 emits laser beams LK, LY, LM, LC according to image data for the four colors onto surfaces of photosensitive drums 52K, 52Y, 52M, 52C, which are arranged outside of the belt 23. Thus, the surfaces of the photosensitive drums 52K, 52Y, 52M, 52C are selectively exposed to the laser beams LK, LY, LM, LC respectively.

The processing unit 32K is for forming an image in black and includes a developer roller 51K, a photosensitive drum 52K, a charger 53, and the transfer roller 54K. The developer roller 51K, the photosensitive drum 52K, and the charger 53 are arranged outside of the belt 23, and the transfer roller 54K is arranged on the inner side of the belt 23. The developer roller 51K supplies a black toner to the photosensitive drum 52K.

The surface of the photosensitive drum 52K is electrically charged evenly by the charger 53, and the charged surface of the photosensitive drum 52K is selectively exposed to the laser beam LK from the scanner unit 31. Thus, the exposed area forms an electrostatic latent image. Thereafter, the toner is supplied to the electrostatic latent image by the developer roller 51K so that a toner image in black is developed on the photosensitive drum 52K.

The toner image developed on the photosensitive drum 52K is transferred by static electricity in the transfer roller 54K onto the sheet W being conveyed on the belt 23. Thus, the image is formed in the black toner on the sheet W. In the following description, an area, in which the toner image can be transferred to the sheet W, will be referred to as an image forming area GR. The image forming area GR include an image forming area GRK for black, an image forming area GRY for yellow, an image forming area GRM for magenta, and an image forming area GRC for yellow (see FIG. 4). In this regard, the processing units 32Y, 32M, 32C for yellow, magenta, cyan are in the similar configuration as the processing unit 32K for black; therefore, description of those are herein omitted.

The fixing unit 33 thermally fixes the toner image transferred onto the sheet W thereat. The sheet W conveyed through the fixing unit 33 is conveyed upward by the ejection rollers 6 and ejected on an ejection tray 2A, which is arranged at a top of the main casing 2.

Figure 2:
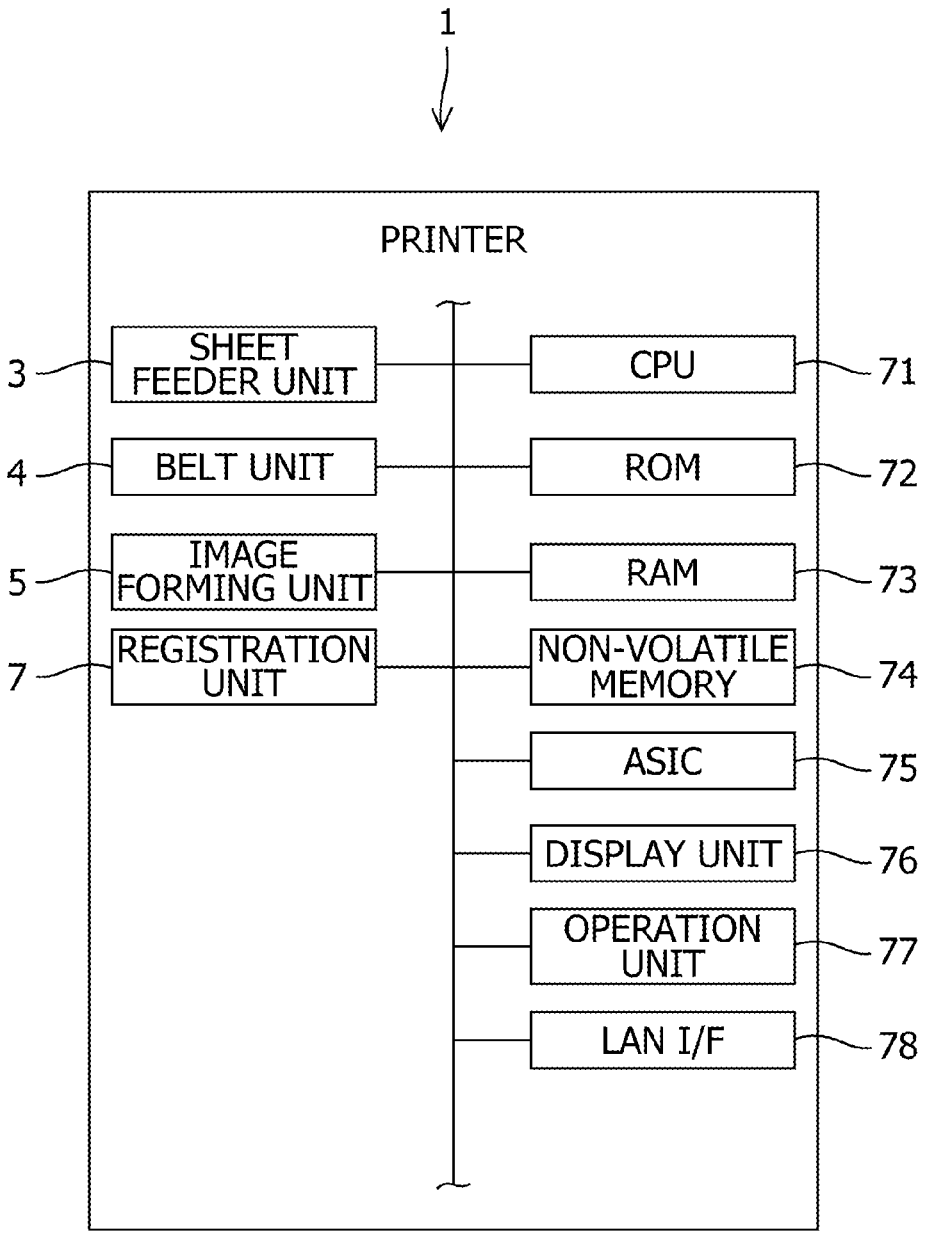
FIG. 2 is a block diagram to illustrate electrical configuration of the printer according to the exemplary embodiment of the present disclosure.

Further to the sheet feeder unit 3, the belt unit 4 and the image forming unit 5 described above, the printer 1 includes, as shown in FIG. 2, a central processing unit (CPU) 71, a read-only memory (ROM) 72, a random access memory (RAM) 73, a non-volatile memory 74, an application specific integrated circuit (ASIC) 75, a display unit 76, an operation unit 77, and a network interface 78.

The ROM 72 stores a various types of programs including a program to control rotation of rollers such as the driving roller 22 in the belt unit 4 and the registration roller 24. The RAM 73 and the non-volatile memory 74 provide work areas for the programs when the programs are running and temporary storages for data being used in the programs. The non-volatile memory 74 may be a writable memory device including an NVRAM, a flash memory, an HDD, an EEPROM.

The CPU 71 is connected with various components in the printer 1, including the ROM 72 and the RAM 73, and controls the components according to the programs read from the ROM 72. The display unit 76 includes a liquid crystal display and lamps (not shown) and is capable of displaying information concerning settings, behaviors of the printer 1, and processes executed in the printer 1, through various forms of screens. The operation unit 77 includes a plurality of buttons (not shown) and is capable of receiving various types of inputs and instructions from a user. The network interface 78 is an interface, through which communication between the printer 1 and an external device (not shown) is exchanged in wireless or wired communication.

Next, with reference to FIGS. 3-5, a detailed configuration of the belt unit 4 is described below. The frame 28 of the belt unit 4 supports bearings (unsigned) of the support roller 21, the driving roller 22, the registration roller 24, the pinch roller 25, and the transfer rollers 54 through a pair of main parts 28B, which longitudinally extend along a direction of conveyance to convey the sheet W. Thereby, the support roller 21, the driving roller 22, the registration roller 24, the pinch roller 25, and the transfer rollers 54 are supported in an arrangement such that directions of rotation axes thereof are in parallel with one another. In the following description, the direction in parallel with the rotation axes of the support roller 21, the driving roller 22, the registration roller 24, the pinch roller 25, and the transfer rollers 54 will be referred to as a direction of rotation axis. The direction of rotation axis coincides with the widthwise direction of the printer 1 according to the exemplary embodiment. The frame 28 further includes intermediate parts 28C, which connect the paired main parts 28B with each other along the direction of rotation axis. The intermediate parts 28C are arranged in positions between the transfer rollers 54.

A width Wb, which is a dimension of the belt 23 along the direction of rotation axis, is smaller than a width Wt of the transfer rollers 54 along the direction of rotation axis. In this regard, a maximum allowable dimension of the image forming area GR along the direction of rotation axis in each of the processing units 32K-32C is limited by the width Wt of the transfer rollers 54 along the direction of rotation axis. In other words, the width Wb of the belt 23 along the direction of rotation axis is set to be smaller than the dimension of the image forming area GR along the direction of rotation axis.

Therefore, in a plan view from above with regard to the direction of gravity (see FIG. 4), each transfer roller 54 is in an arrangement with regard to the direction of rotation axis such that a part of the transfer roller 54 is in an overlapping area G1, in which the transfer roller 54 coincides with the upper outer surface of the belt 23 along the direction of rotation axis, and a remainder part of the transfer roller 54 is in an exposed area G2, in which the transfer roller 54 is displaced from the upper outer surface of the belt 23 along the direction of rotation axis. In this regard, the arrangement that the transfer roller 54 coincides with the belt 23 along the direction of rotation axis refers to a condition that the transfer roller 54 and the belt 23 fall on a same area with regard to the direction of rotation axis. In other words, the transfer roller 54 overlaps the belt 23 in a view along a direction orthogonal to the direction of rotation axis, which is, according to the exemplary embodiment, the direction of gravity. Meanwhile, the arrangement that the transfer roller 54 is displaced from the belt 23 refers to a condition that the transfer roller 54 and the belt 23 do not overlap each other in a view along the direction orthogonal to the direction of rotation axis. The transfer rollers 54K-54C are opposed to the photosensitive drums 52K-52C respectively, across the belt 23 in the overlapping area G1, and directly in the exposed area G2. In other words, in the overlapping area G1, the belt 23 contacts the photosensitive drums 52K-52C, while in the exposed area G2 the transfer rollers 54K-54C contact the photosensitive drums 52K-52C respectively. Meanwhile, the intermediate parts 28C coincident with the exposed area G2 include ribs 28D, which extend along the direction of conveyance to guide the sheet W.

In the exemplary embodiment, the belt 23 and the transfer rollers 54 are in an arrangement such that a center of the belt 23 along the direction of rotation axis is aligned with centers of the transfer rollers 54 along the direction of rotation axis. Therefore, at each side of the belt 23 along the direction of rotation axis, the exposed area G2 is provided. In other words, two (2) exposed areas G2 are arranged on outer sides of the overlapping area G1 along the direction of rotation axis.

The support roller 21 is formed in a hollow cylindrical shape and has spokes (unsigned) expanding in radial directions at axial ends thereof. The support roller 21 is held via the spokes in a position to be centered at a rotation shaft 21A. In this regard, the support roller 21 is formed separately from the rotation shaft 21A and rotates idly with respect to the rotation shaft 21A.

The driving roller 22 is formed in a hollow cylindrical shape and has spokes (not shown) expanding in radial directions at axial ends thereof. The driving roller 22 is held via the spokes in a position to be centered about a rotation shaft 22A. In this regard, the driving roller 22 is fixed to the rotation shaft 22 A and rotates integrally with the rotation shaft 22A.

The driving roller 22 is rotated by a driving force from a motor (not shown), which is activated according to an instruction from the CPU 71, and applies a circulating force to the belt 23. The support roller 21 is arranged on an upstream side of the driving roller 22 with regard to the direction of conveyance and is rotated by the circulation of the belt 23.

While the belt 23 is strained around the support roller 21 and the driving roller 22, a dimension Ws of the support roller 21 and a dimension Wk of the driving roller 22 along the direction of rotation axis should at least as large as or substantially larger than the width Wb of the belt 23 along the direction of rotation axis. While the width Wb of the belt 23 along the direction of rotation axis is smaller than the width Wt of the transfer rollers 54, therefore, the dimensions Ws, Wk of the support roller 21 and the driving roller 22 are smaller than the dimension Wt of the transfer rollers 54 along the direction of rotation axis and substantially larger than the width Wb of the belt 23 along the direction of rotation axis.

The support roller 21 is provided with a pair of flange parts 21B. Each of the flange parts 21B is formed to spread outwardly with respect to a part of the support roller 21 which contacts the belt 23 along a radial direction. The flange part 21B is arranged in each exposed area G2, which is on an outer side of the belt 23 along the direction of rotation axis. The flange parts 21B are arranged to face with cross-sectional edges of the belt 23, which are at widthwise ends along the direction of rotation axis, and restrict the belt 23 from moving in the direction of rotation axis.

Next, the registration roller 24, the pinch roller 25, and the sheet sensor 26 will be described. As shown in FIG. 1, the registration roller 24, the pinch roller 25, and the sheet sensor 26 are arranged on a downstream side of the support roller 21 and on an upstream side of the transfer rollers 54, i.e., an upstream side of the image forming area GR, with regard to the direction of conveyance. The registration roller 24 is made of a material, of which friction coefficient is relatively large, such as rubber, compared to a material of the pinch roller 25.

The registration roller 24 has a cylindrical form, which is rotatable about a rotation axis 24A. The registration roller 24 includes two (2) pieces of registration rollers 24, which align along the direction of rotation axis. Each of the two registration rollers 24 is arranged on each side of the belt 23 along the direction of rotation axis, that is, in each exposed area G2 located on each side of the overlapping area G1 with regard to the direction of rotation axis.

Figure 5:
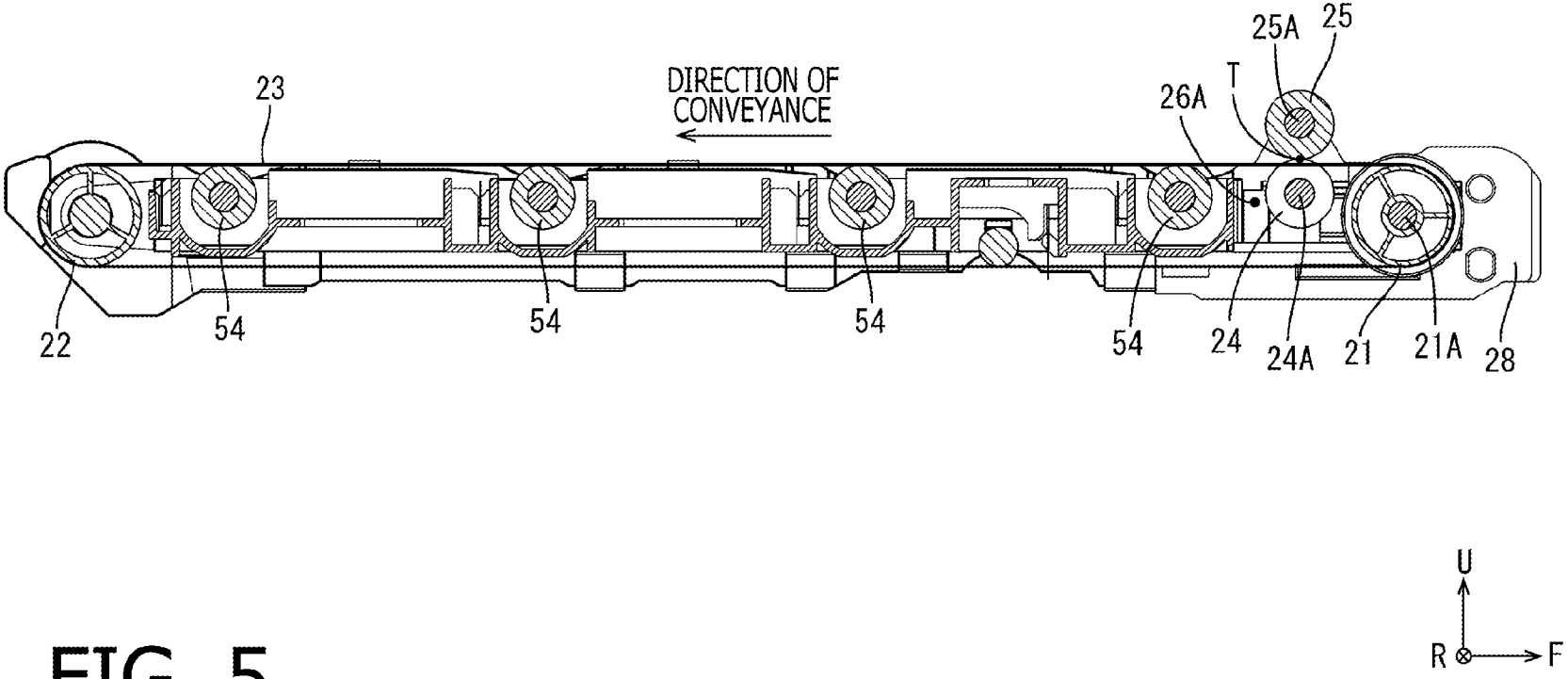
FIG. 5 is a cross-sectional view of the belt unit of the printer, taken along a line A-A shown in FIG. 4, according to the exemplary embodiment of the present disclosure.

As shown in FIG. 5, the registration roller 24 is arranged to locate the rotation axis 24A thereof on a side of a reverse surface of the belt 23, i.e., on an inner side of the belt 23. At the same time, the registration roller 24 is arranged to locate an upper end thereof to protrude upward from the upper outer surface of the belt 23 in a view taken along the direction of axes.

Figure 3:
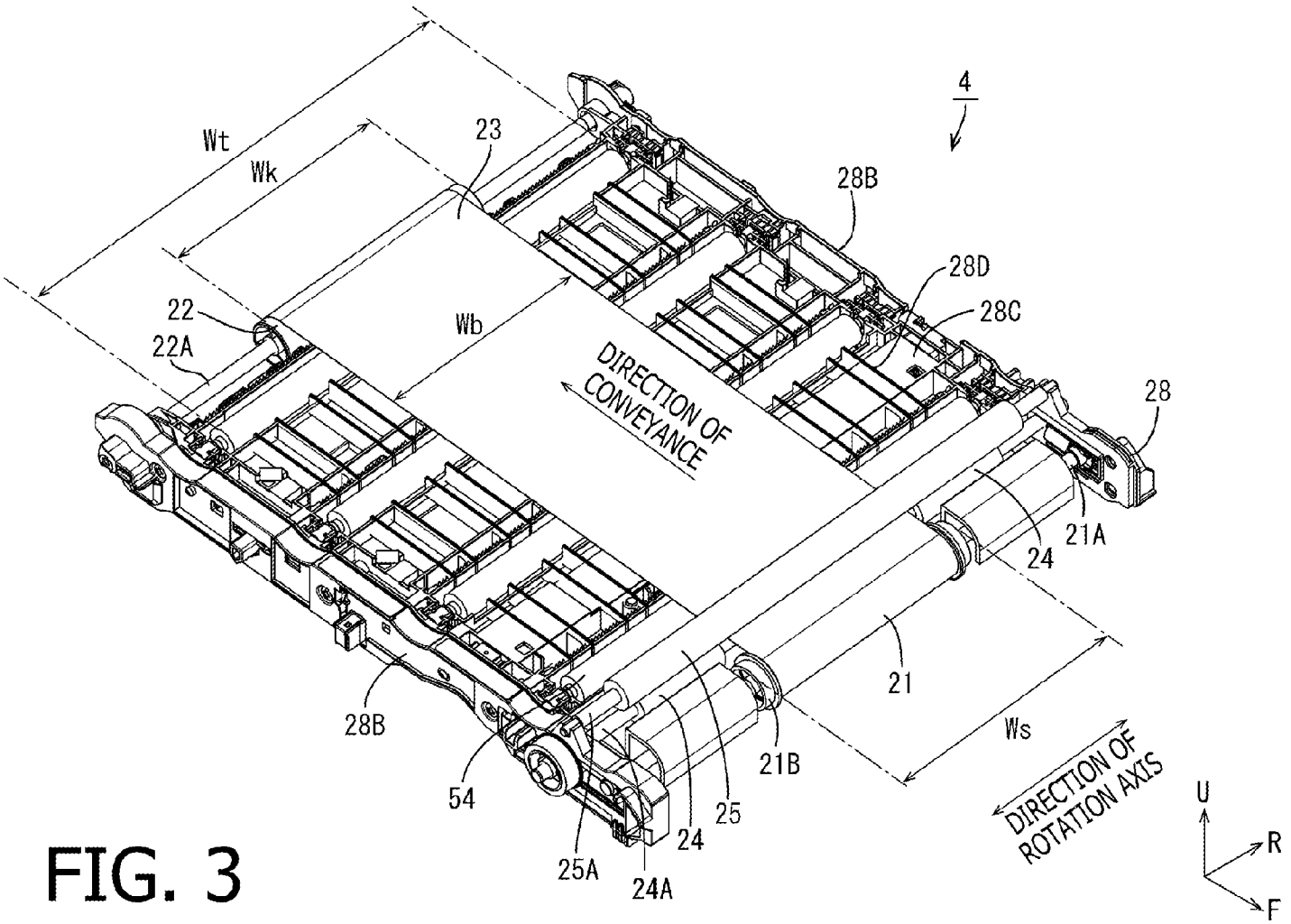
FIG. 3 is a perspective view of a belt unit of the printer according to the exemplary embodiment of the present disclosure.

As shown in FIG. 3, the pinch roller 25 has a cylindrical form, which is rotatable about a rotation axis 25A. The pinch roller 25 is arranged to oppose to the registration rollers 24 and in a range along the direction of rotation axis between a leftward end of the registration roller 24 on the left and a rightward end of the registration roller 24 on the right. The pinch roller 25 is a roller coated with fluorine, of which friction coefficient is lower than the registration roller 24.

As shown in FIG. 5, the pinch roller 25 is in an arrangement such that the rotation axis 25A thereof is on the outside of the belt 23, and a lower end thereof contacts the upper ends of the registration rollers 24. Therefore, a contact part T, at which the registration roller 24 and the pinch roller 25 contact each other, is in a position upwardly apart from the upper outer surface of the belt 23.

Figure 4:
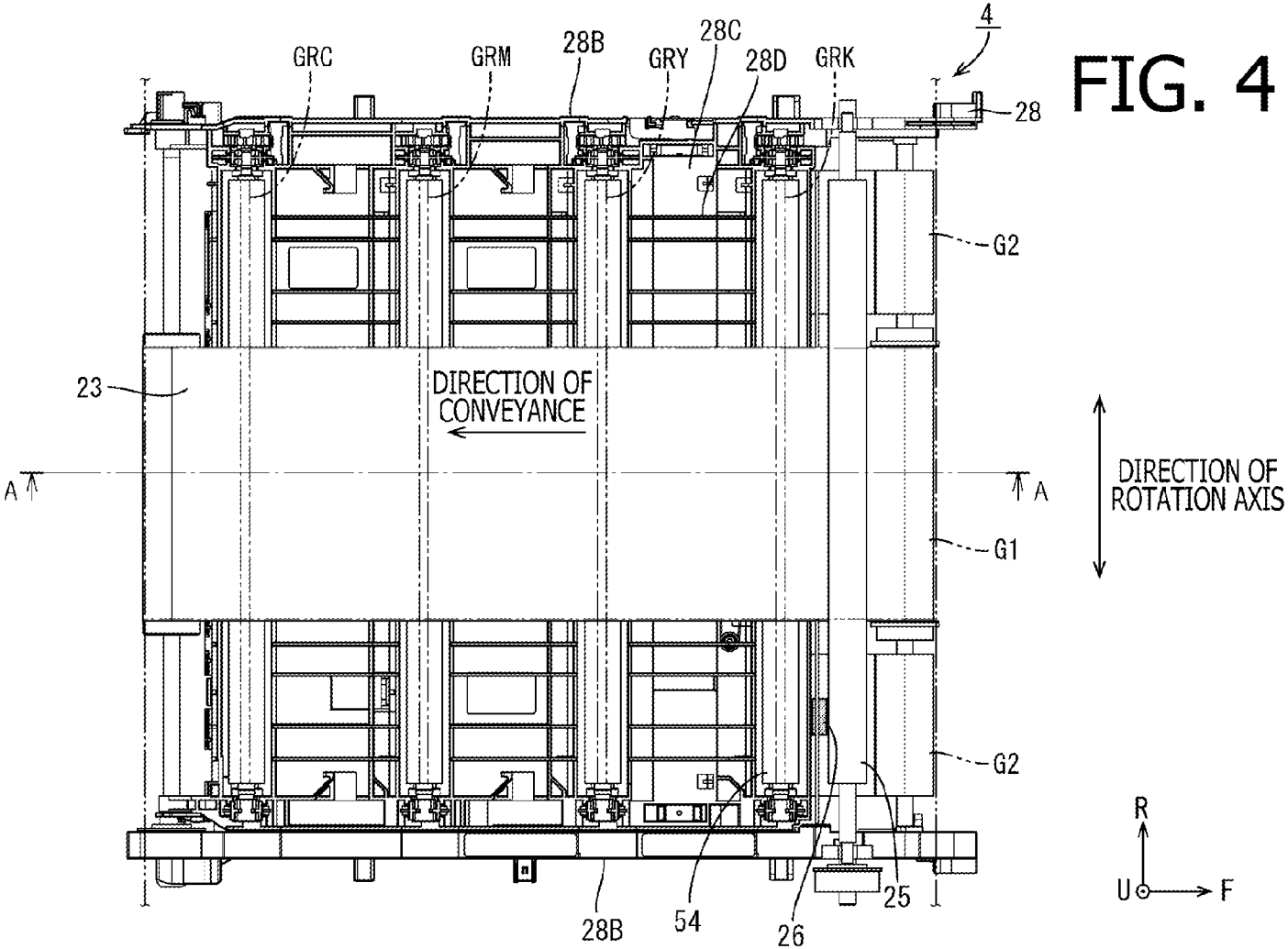
FIG. 4 is a top plan view of the belt unit of the printer according to the exemplary embodiment of the present disclosure.

As shown in FIG. 4, the sheet sensor 26 is arranged in a position displaced from the belt 23 along the direction of rotation axis. In particular, the sheet sensor 26 is arranged in the exposed area G2 on the left of the overlapping area G1 with regard to the direction of axes and in a position closer to the belt 23 than a leftward end of the transfer roller 54 with regard to the direction of axes. The sheet sensor 26 includes an arm 26B (see FIG. 1), which is rotatable about a rotation axis 26A. The sheet sensor 26 is arranged to locate the rotation axis 26A on the inner side of the belt 23 and to locate an upper end of the arm 26B to protrude upwardly from the upper outer surface of the belt 23. When a leading end of the sheet W being conveyed contacts the arm B, the arm 26B pivots, and the sheet sensor 26 sensing the pivot outputs detection signal, which indicates the leading end of the sheet W reaching a detectable area.

A driving force to drive the registration roller 24 is generated in a motor (not shown) and input to the registration roller 24 through an electromagnetic clutch (not shown). The registration roller 24 is rotated by the electromagnetic clutch when the electromagnetic clutch receives a driving instruction from the CPU 71 and is connected with the registration roller 24. On the other hand, the registration roller 24 does not rotate or stops rotating when the electromagnetic clutch receives a stopping instruction from the CPU 71 and is disconnected from the registration roller 24. The pinch roller 25 is rotated along with the rotation of the registration roller 24 and conveys the sheet W to the belt 23 in conjunction with the registration roller 24.

For example, in advance to the leading end of the sheet W reaching the contact part T between the registration roller 24 and the pinch roller 25, the CPU 71 outputs the stopping instruction to the electromagnetic clutch to stop the rotation of the registration roller 24 and the pinch roller 25. Therefore, the sheet W being conveyed by the pickup roller 12 and the feeder rollers 13 is lead to contact the pinch roller 25, of which friction coefficient is smaller than that of the registration roller 24, until the leading end of the sheet W reaches the contact part T, and stops thereat.

While the contact part T is formed longitudinally to extend along the direction of rotation axis, an orientation of the sheet W reaching the contact part T is corrected by the contact with the contact part T to a reference orientation, in which the leading end of the sheet W aligns with the direction of rotation axis. After the leading end of the sheet T reaches the contact part T, the CPU 71 outputs the driving instruction to the electromagnetic clutch at a predetermined timing and manipulates the registration roller 24 and the pinch roller 25 to rotate. Thus, the sheet W aligned with the reference orientation is fed to the belt 23 and passed onto the belt 23.

Meanwhile, the CPU 71 manipulates the driving roller 22 to rotate at a constant velocity to circulate the belt 23 at a constant velocity. In this regard, the belt 23 is continuously rotated regardless of that whether the registration roller 24 and the pinch roller 25 are rotating or halted. The sheet W fed to the belt 23 is conveyed to the rear side by the belt 23 rotating at the constant velocity.

According to the exemplary embodiment described above, the belt unit 4 includes the registration roller 24 and the pinch roller 25, which convey the sheet W in the reference orientation. The registration roller 24 is disposed in the exposed area G2, which is displaced from the belt 23 along the direction of rotation axis, and the rotation axis of the registration roller 24 is on the inner side of the belt 23. The pinch roller 25 is arranged to locate the rotation axis thereof on the outer side of the belt 23 and to contact the registration roller 24. According to the above configuration, compared to a configuration, in which the both rotation axes of the registration roller and the pinch roller are located outside the belt 23, a distance for the sheet W to travel after being corrected to the reference orientation until the sheet W reaches the belt 23 may be shortened. Therefore, the sheet W may be restrained from reaching the belt 23 in a skewed orientation.

According to the exemplary embodiment described above, the registration roller 24 is disposed on each side of the belt 23 along the direction of rotation axis, in each of the exposed areas G2. Therefore, compared to a configuration, in which the registration roller is disposed solely in the exposed area G2 on one side of the belt 23 along the direction of rotation axis, the sheet W may be restrained from being skewed from the reference orientation when the registration roller 24 and the pinch roller 25 convey the sheet W.

According to the exemplary embodiment described above, the contact part T between the registration roller 24 and the pinch roller 25 is located on the upper side of the belt 23 and in the position apart from the upper outer surface of the belt 23. Therefore, when the orientation of the sheet W is being corrected by the registration roller 24 and the pinch roller 25, or when the sheet W is conveyed by the registration roller 24 and the pinch roller 23, an undesirable influence on the orientation of the sheet W, which may otherwise be caused by the sheet W touching the moving belt 23, may be restrained.

According to the exemplary embodiment described above, the support roller 21, the driving roller 22, the registration roller 24, the pinch roller 25, and the transfer rollers 54 are supported by the same frame 28; therefore, these rollers 21, 22, 24, 25, 54 may be restricted from inclining with respect to one another.

According to the exemplary embodiment described above, while the orientation of the sheet W is corrected by stopping the rotation of the registration roller 24 or maintaining the registration roller 24 motionless, the CPU 71 maintains the circulation of the belt 23; therefore, the CPU 71 may continuously convey a plurality of sheets W without stopping the circulation of the belt 23 and form images on the sheets W while the registration roller 24 is motionless.

According to the exemplary embodiment described above, the sheet sensor 26 is disposed in the exposed area G2, which is displaced from the belt 23 along the direction of rotation axis, and in the position closer to the transfer rollers 54 than the registration roller 24 is with regard to the direction of conveyance. Therefore, the timing to convey the orientation-corrected sheet W in the reference orientation to the image forming area GR may be determined by use of the sheet sensor 26 effectively.

According to the exemplary embodiment described above, the rotation axis 26A of the arm 26B of the sheet sensor 26 is located on the inner side of the belt 23. Therefore, compared to a configuration, in which the rotation axis 26A is located on the outside of the belt 23, the printer 1 may be downsized.

Next, the printer 1 according to another exemplary embodiment will be described with reference to FIGS. 6-7. In the exemplary embodiment, the printer 1 is different from the printer 1 described in the previous exemplary embodiment in that the registration rollers 24 are arranged to align with the support roller 21 along the direction of rotation axis, and that an attraction roller 21 is arranged to align with the pinch roller 25 along the direction of rotation axis. In the following description, items or structures which are the same as or similar to the items or the structures described in the previous exemplary embodiment will be referred to by the same reference signs, and description of those will be omitted.

Figure 6:
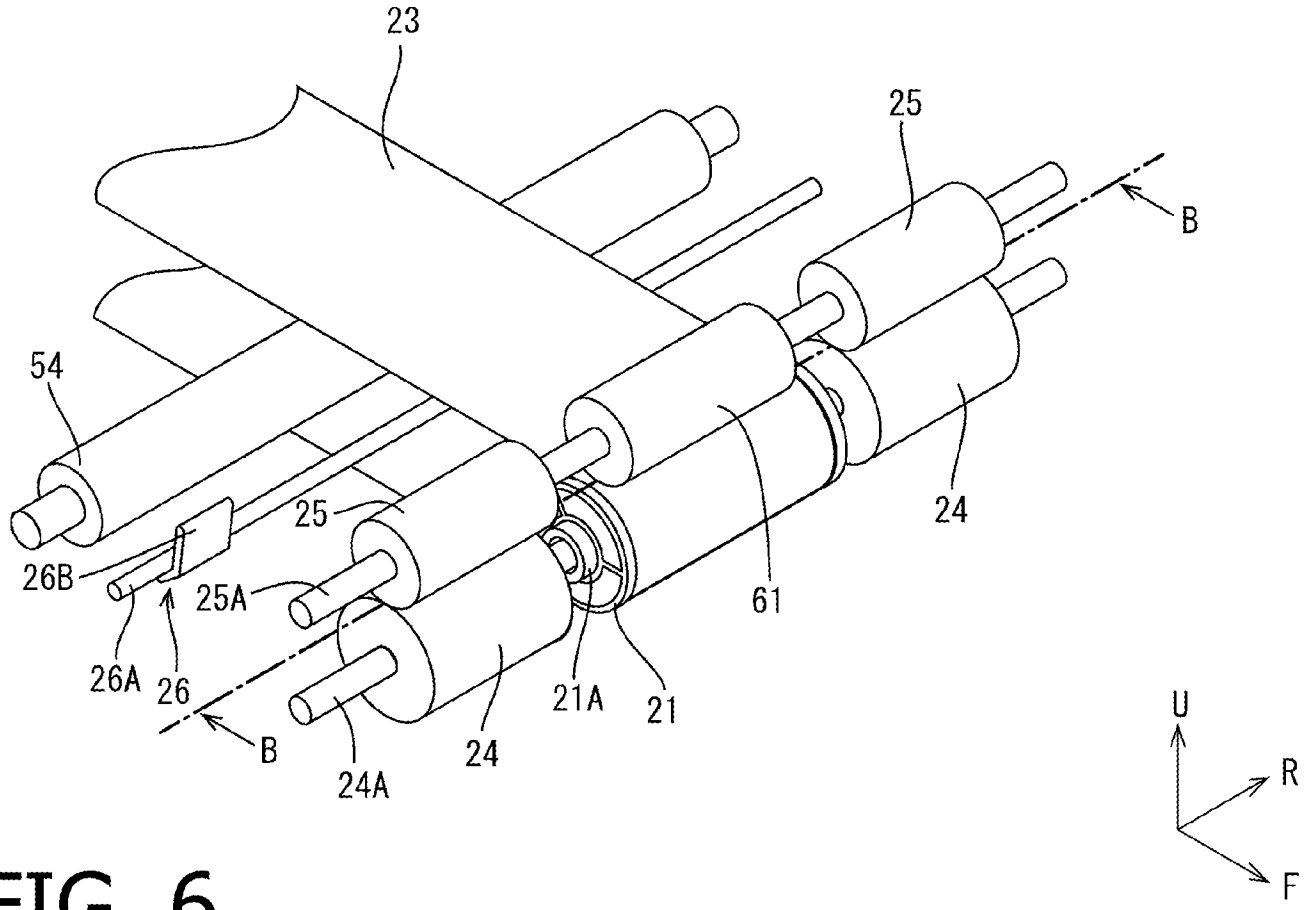
FIG. 6 is an illustrative view of a part of the belt unit of the printer according to the exemplary embodiment of the present disclosure.
Figure 7:
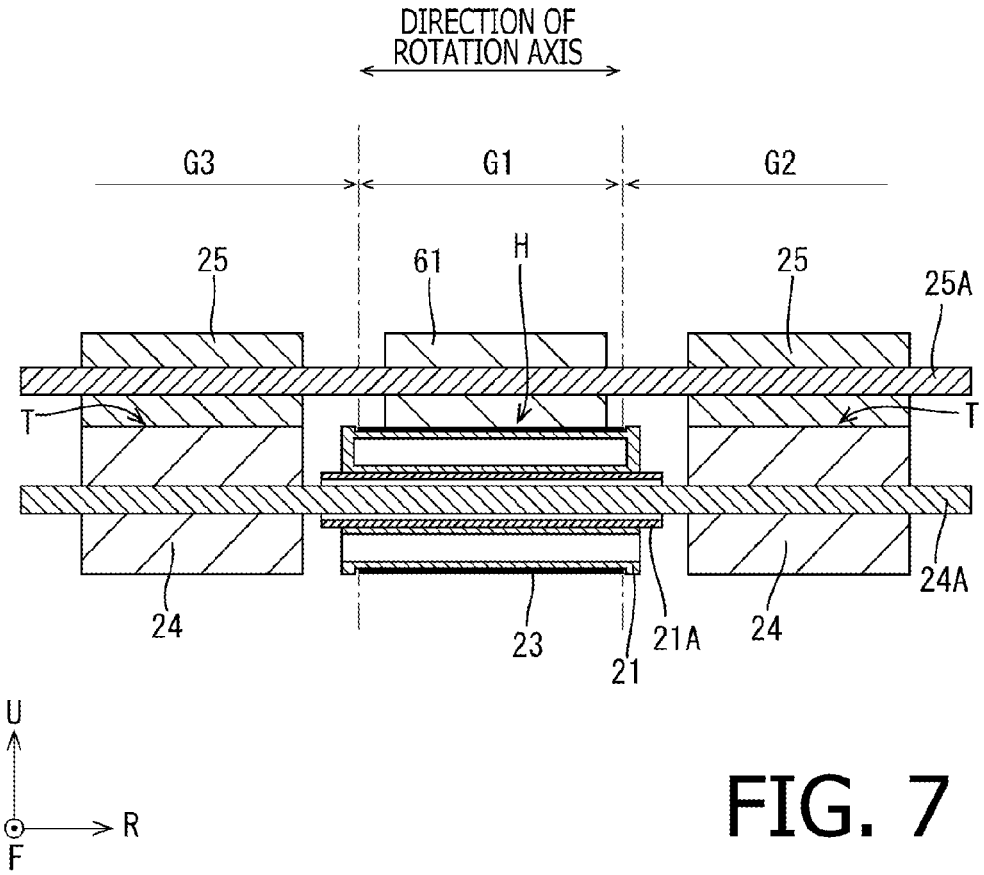
FIG. 7 is a cross-sectional view of the belt unit of the printer, taken along a line A-A shown in FIG. 6, according to the exemplary embodiment of the present disclosure.

As shown in FIG. 6, each of the two pieces of registration rollers 24 is arranged on each side of the support roller 21 along the direction of rotation axis. As shown in FIG. 7, the rotation shaft 21A of the support roller 21 has a form of a tubular hollow shaft, in which the rotation shaft 24A of the registration rollers 24 is arranged. Thereby, the registration rollers 24 arranged on the both sides of the support roller 21 along the direction of rotation axis rotate coaxially about the rotation shaft 24A integrally with each other.

The rotation shaft 21A of the support roller 21 is arranged separately from the rotation shaft 24A of the registration rollers 24; therefore, the support roller 21 rotates independently from the rotation of the registration rollers 24. An inner diameter of the rotation shaft 21A is larger than an outer diameter of the rotation shaft 24A. Therefore, even when the support roller 21 is urged by the resilient member 27 in the direction to be away from the driving roller 22, the rotation shaft 24A may be restrained from contacting the rotation shaft 21A.

The pinch roller 25 includes two (2) pieces of pinch rollers 25, which are arranged to align along the direction of rotation axis. Each pinch roller 25 is arranged to face and contact one of the two registration rollers 24. Thus, each of the pinch rollers 25 is arranged on each side of the belt 23 along the direction of rotation axis and in each of the exposed areas G2, which are on the both sides of the overlapping area G1 along the direction of rotation axis.

The attraction roller 61 is arranged in a position between the two pinch rollers 25 along the direction of axes. The attraction roller 61 electrically charges the sheet W being conveyed to the belt 23 so that the sheet W should be attracted to the belt 23. The attraction roller 61 is in a cylindrical form and shares the rotation shaft 25A with the pinch rollers 25.

The attraction roller 61 is arranged in a position to coincide with the outer upper surface of the belt 23 with regard to the direction of rotation axis. In other words, the attraction roller 61 is arranged in the overlapping area G1, and a lower end of the attraction roller 61 is located to contact the belt 23. A contact part H between the attraction roller 61 and the belt 23 is arranged to align substantially with a same line along the direction of rotation axis as the contact parts T between the registration rollers 24 and the pinch rollers 25. In this regard, the attraction roller 61 is arranged to oppose to the support roller 21 across the belt 23.

According to the exemplary embodiment described above, the support roller 21 and the registration rollers 24 are arranged to align along the direction of rotation axis. Therefore, compared to a configuration, in which the support roller 21 and the registration rollers 24 do not align with one another along the direction of rotation axis, the printer 1 may be downsized.

According to the exemplary embodiment described above, the registration rollers 24 arranged on the both sides of the belt 23 along the direction of rotation axis rotate integrally with each other through the rotation shaft 24A which is arranged inside the hollow rotation shaft 21A of the support roller 21. Therefore, compared to a configuration, in which the registration rollers 24 rotate independently from each other, the sheet W may be restrained from skewing with respect to the reference orientation.

Next, the printer 1 according to still another exemplary embodiment will be described with reference to FIGS. 8-10. In the exemplary embodiment, the printer 1 is different from the printer 1 described in the previous exemplary embodiments in that the printer 1 includes a registration member 63 arranged on a rotation shaft of the pinch roller 25. In the following description, items or structures which are the same as or similar to the items or the structures described in the previous exemplary embodiment will be referred to by the same reference signs, and description of those will be omitted.

Figure 8:
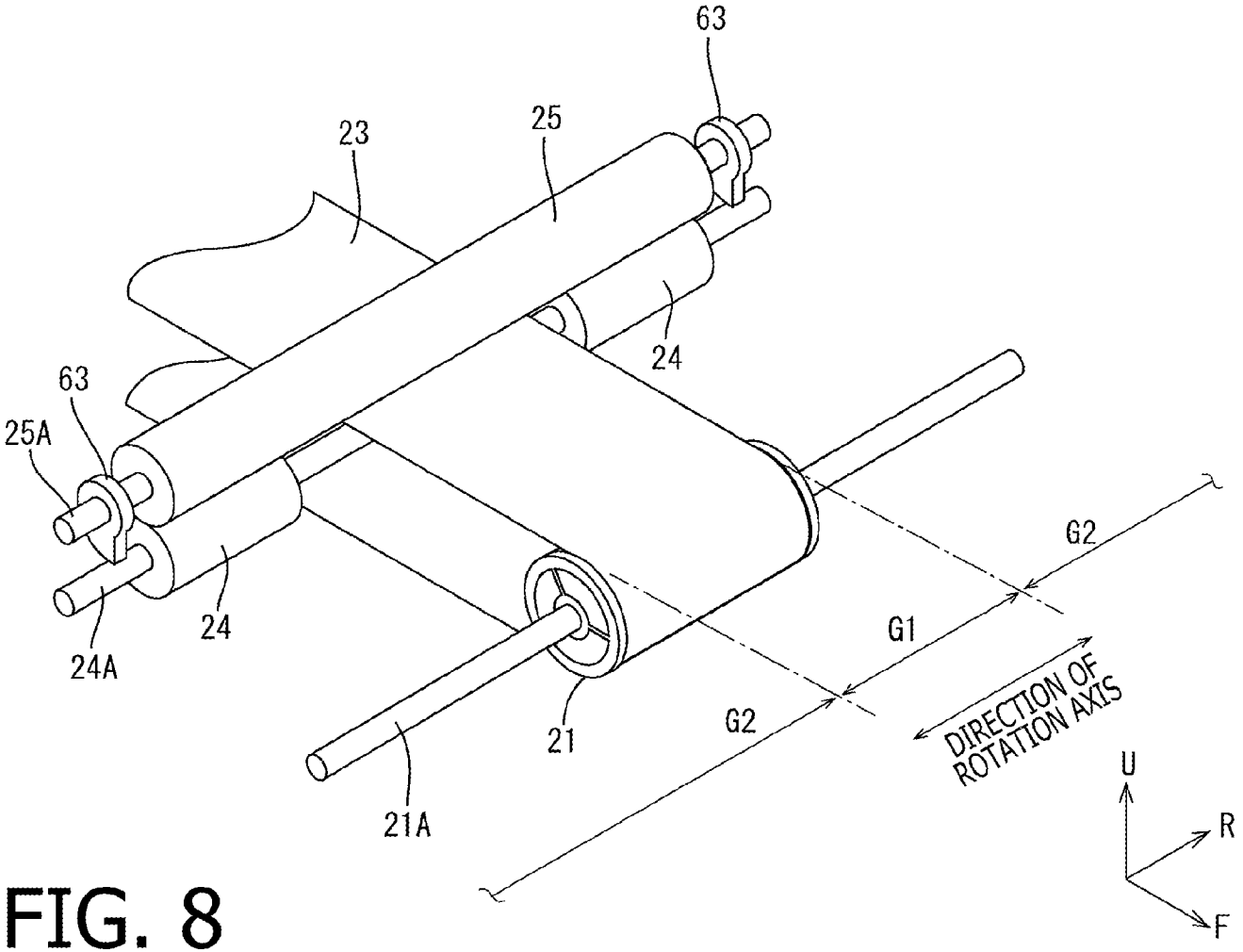
FIG. 8 is an illustrative view of a part of the belt unit of the printer according to an exemplary embodiment of the present disclosure.
Figure 9:
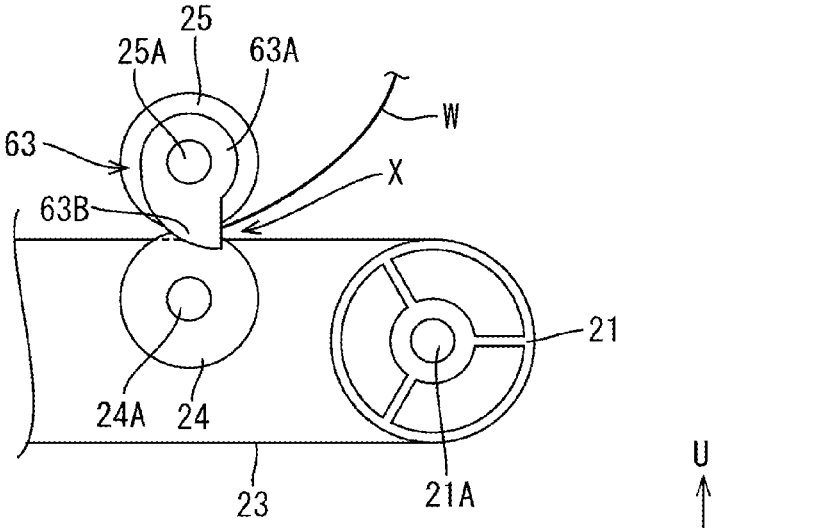
FIG. 9 is an illustrative side view of a part of the belt unit of the printer according to the exemplary embodiment of the present disclosure.

As shown in FIG. 8, the registration member 63 includes two (2) pieces of registration members 63, which are arranged along the direction of rotation axis and are rotatable about the rotation shaft 25A of the pinch roller 25. The registration members 63 are arranged on outside of the belt 23 and in outer positions than the pinch roller 25 with regard to the direction of rotation axis, in the exposed areas G2 which are on the outer sides of the overlapping area G1. As shown in FIG. 9, each registration member 63 is formed to have a projection 63B, which projects outward in a radial direction from a cylindrical main part 63A, and is placed to halt in a posture, in which the projection 63B is in a lower position. In the following description, the lower position of the projection 63B shown in FIG. 9 will be defined as a contact position.

When the projection 63B is in the contact position, a face of the projection 63B on the upstream side with regard to the direction of conveyance is on an upstream side of the contact part T between the registration roller 24 and the pinch roller 25. In the following description, the face of the projection 63B on the upstream side with regard to the direction of conveyance is defined as a contact face X. With the projection 63B in the contact position, therefore, the sheet W conveyed by the feeder roller 12 and the feeder rollers 13 contacts the contact face X prior to reaching the contact part T.

When the leading end of the sheet W being conveyed contacts the contact face X, a rotating force is applied from the sheet W to the registration member 63, and the registration member 63 rotates about the rotation shaft 25A of the pinch roller 25 along the conveyance of the sheet W toward the downstream with regard to the direction of conveyance. The contact face X spreads along the direction of rotation axis; therefore, when the sheet W contacts the contact face X, the leading edge of the sheet W aligns with the direction of rotation axis by rotation resistance of the registration member 63, and the orientation of the sheet W is corrected to the reference orientation. The rotation resistance may be caused in the registration member 63 by, for example, own weight of the registration member 63 or by a spring (not shown).

When the sheet W is conveyed to the belt 23, the CPU 71 manipulates the registration roller 24 to rotate at a constant velocity. Therefore, when the leading end of the sheet W in the corrected reference orientation reaches the contact part T between the registration roller 24 and the pinch roller 25, the sheet W is conveyed by the registration roller 24 and the pinch roller 25 in the direction of conveyance.

Figure 10:
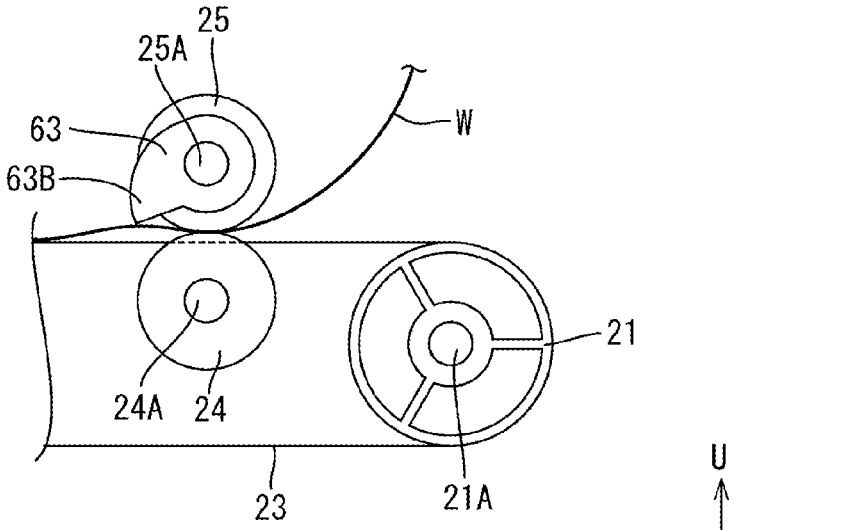
FIG. 10 is another illustrative side view of the part of the belt unit of the printer according to the exemplary embodiment of the present disclosure.

Thereafter, as shown in FIG. 10, when the projection 63B comes to an upper position higher than the sheet W being conveyed, the registration members 63 stop rotating thereat while the sheet W passes underneath the registration members 63 to be conveyed to the belt 23. In the following description, the upper position of the projection 63B higher than the sheet W being conveyed is defined as a conveyable position. The projection 63B is maintained stopped at the conveyable position throughout a period during the sheet W passes through the registration members 63. When the sheet W is conveyed through, the registration members 63 are rotated to return to the contact position on the upstream side of the contact part T with regard to the direction of conveyance.

According to the exemplary embodiment described above, while the orientation of the sheet W is corrected by the registration members 63, the CPU 71 maintains the registration roller 24 rotating. Therefore, the rotation of the registration roller 24 may not necessarily be stopped while the orientation of the sheet W is corrected, and control over the registration roller 24 by the CPU 71 may be simplified.

Although examples of carrying out the disclosure have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the image forming apparatus may not necessarily be limited to the multicolor laser printer but may be a printer for forming images in a different image-forming method, such as an inkjet printer with the belt conveyer. In the inkjet printer, for example, an ink ejecting area for an inkjet head may equivalently serve as the image forming area GR. For another example, the image forming apparatus may not necessarily be a multicolor printer but may be a monochrome printer.

For another example, the support roller 21 and the driving roller 22 may not necessarily be the only rollers to strain the belt 23 around, but an additional roller to strain the belt 23 around may be provided in addition to the support roller 21 and the driving roller 22.

For another example, rotation of the rollers including the driving roller 22 the registration roller 24 may not necessarily be controlled by the single CPU 71 but may be controlled by a plurality of CPUs, or may be controlled by a dedicated hardware circuit such as the ASIC 75 or by the CPU(s) and hardware circuits.

For another example, the sheet sensor 26 may not necessarily detect the presence of the sheet W by the mechanical contact of the sheet W with the arm 26B but may detect the sheet W optically by emitting light toward the sheet W and receiving light reflected on the sheet W.

For another example, the registration roller 24 may not necessarily be arranged to have the rotation axis 24A thereof to extend continuously through the inner side of the belt 23 along the direction of rotation axis as long as the rotation axis 24A of the registration roller 24 is located on the inner side of the belt 23 when the belt unit 4 is viewed along the direction of rotation axis. Further, the pinch roller 25 may not necessarily be arranged to have the rotation axis 25A thereof to extend continuously through the outer side of the belt 23 along the direction of rotation axis as long as the rotation axis 25A of the pinch roller 25 is located on the outer side of the belt 23 when the belt unit 4 is viewed along the direction of rotation axis.

For another example, the belt 23 may not necessarily be arranged to locate the center thereof along the direction of rotation axis to align with the center of the transfer roller 54 along the direction of rotation axis. For example, the belt 23 may be arranged to locate a leftward end thereof to align with a leftward end of the transfer roller 54. For another example, the belt 23 may not necessarily be a single piece of belt 23 but may include a plurality of pieces of belts 23.

For another example, the width Wb of the belt 23 along the direction of rotation axis may not necessarily be smaller than the dimension Wt of the transfer rollers 54 but may be substantially the same dimension as the dimension Wt of the transfer rollers 54. If the width Wb of the belt 23 along the direction of rotation axis is substantially as wide as the dimension Wt of the transfer rollers 54, it may be necessary that a width of the sheet W along the direction of rotation axis is larger than the dimension Wt of the transfer rollers 54 along the direction of rotation axis, and the registration rollers 24 may be disposed in areas where the sheet W spreads beyond the transfer rollers 54 along the direction of rotation axis so that the orientation of the sheet W is corrected by the registration rollers 24 disposed in the spread-beyond areas.

For another example, the registration roller 24 may not necessarily include two (2) pieces of registration rollers 24 arranged to align along the direction of rotation axis. If a single piece of registration roller 24 is formed to have a larger dimension along the direction of rotation axis so that the orientation of the sheet W may be corrected by the single piece of registration roller 24, a quantity of the registration roller 24 may be one (1). Similarly, a quantity of the registration members 63 may not necessarily be limited to two (2) but may be one (1).

For another example, the support roller 21 may not necessarily serve to apply the tensile force to the belt 23. In other words, the support roller 21 may not necessarily be movable with respect to the registration roller 24 along the direction orthogonal to the direction of rotation axis. If so, the rotation axis 24A of the registration roller 24, which is on the inner side of the rotation shaft 21A of the support roller 21, may be located coaxially on the rotation shaft 21A of the support roller 21. Thereby, when the support roller 21 and the registration roller 24 are installed in the belt unit 4, a position of one of the support roller 21 and the registration roller 24 may be determined based on a position of the other of the support roller 21 and the registration roller 24.

What is claimed is:

1. An image forming apparatus, comprising:

a conveyer configured to convey a sheet, comprising:

a first roller;

a second roller; and a belt strained around the first roller and the second roller and comprising a first surface and a second surface, the first surface facing one side to contact the sheet, and the second surface facing an opposite side from the first surface;

an image forming unit configured to form an image on the sheet being conveyed in an image forming area, the image forming area comprising at least a part of a first area and at least a part of a second area, the first area being coincident with the first surface of the belt, and the second area being in a same position as the first surface of the belt in a direction of conveyance to convey the sheet by the conveyer, the second area being displaced from the belt along a direction of rotation axis of the first roller; and a registration unit arranged on an upstream side of the image forming area with regard to the direction of conveyance, the registration unit comprising a third roller and a fourth roller, the third roller being arranged to contact the fourth roller and to locate a rotation axis thereof on a side of the first surface, the fourth roller being arranged in the second area with a rotation axis thereof being located on a side of the second surface of the belt, and the registration unit being configured to manipulate the third roller and the fourth roller to align the sheet with a reference orientation and convey the sheet to the belt.

2. The image forming apparatus according to claim 1, wherein the second area is provided on each side of the belt along the direction of rotation axis; and wherein the registration unit comprises the fourth roller, which is arranged in the second area on each side of the belt along the direction of rotation axis.

3. The image forming apparatus according to claim 1, wherein a contact part between the third roller and the fourth roller is located on the side of the first surface in a position apart from the first surface.

4. The image forming apparatus according to claim 1, wherein the first roller is arranged on an upstream side and the second roller is arranged on a downstream side with regard to the direction of conveyance, and wherein the fourth roller is arranged to align with the first roller along the direction of rotation axis.

5. The image forming apparatus according to claim 4, wherein the first roller comprises a hollow shaft;

wherein the second area is provided on each side of the belt along the direction of rotation axis; and wherein the registration unit comprises the fourth roller, which is arranged in the second area on each side of the belt; and wherein a rotation shaft, through which the fourth roller is rotated integrally, is arranged inside the hollow shaft.

6. The image forming apparatus according to claim 5, wherein a rotation axis of the first roller and the rotation shaft of the fourth roller are arranged coaxially.

7. The image forming apparatus according to claim 1, further comprising:

a frame configured to support the first roller, the second roller, and the fourth roller.

8. The image forming apparatus according to claim 1, further comprising:

a feeder roller configured to convey the sheet toward the registration unit; and a controller configured to control the registration unit and the feeder roller, wherein the controller controls the feeder roller to convey the sheet and controls the third roller and fourth roller to stop rotating until a leading end of the sheet being conveyed contacts the third roller and the fourth roller, and thereafter controls the third roller and the fourth roller to start rotating and convey the sheet aligned with the reference orientation to the belt.

9. The image forming apparatus according to claim 8, wherein the controller comprises a conveyer controller configured to control the conveyer, and wherein the conveyer controller controls the belt to circulate while rotation of the third roller and the fourth roller is stopped.

10. The image forming apparatus according to claim 1, wherein the registration unit comprises a contact portion configured to be rotated about a rotation axis, the contact portion being rotatable from a contact position to a conveyable position, the contact position being on an upstream side of a contact part between the third roller and the fourth roller with regard to the direction of conveyance, and the conveyable position being on a downstream side of the contact position with regard to the direction of conveyance.

11. The image forming apparatus according to claim 1, further comprising:

a detector arranged in a position between the fourth roller and the image forming area with regard to the direction of conveyance, the detector being configured to detect presence of the sheet, the detector comprising an arm arranged in the second area.

12. The image forming apparatus according to claim 11, wherein the arm of the detector is rotatable by a contact with the sheet; and wherein a rotation axis of the arm is located on the side of the second surface.

13. The image forming apparatus according to claim 1, wherein the image forming unit comprises:

a photosensitive member arranged on the side of the first surface, the photosensitive member being configured to carry an image formed in a developer agent; and a transfer member arranged on the side of the second surface, the transfer member being configured to transfer the image formed in the developer agent to the sheet in the image forming area.

* * * * *